US005137558A

United States Patent [19]

Agrawal

[11] Patent Number: 5,137,558

[45] Date of Patent: Aug. 11, 1992

[54] LIQUEFIED NATURAL GAS REFRIGERATION TRANSFER TO A CRYOGENICS AIR SEPARATION UNIT USING HIGH PRESURE NITROGEN STREAM

[75] Inventor: Rakesh Agrawal, Allentown, Pa.

[73] Assignee: Air Products and Chemicals, Inc., Allentown, Pa.

[21] Appl. No.: 691,930

[22] Filed: Apr. 26, 1991

[51] Int. Cl.[5] ..... F25J 3/02; F25J 1/00

[52] U.S. Cl. ..... 62/24; 62/8; 62/9; 62/13; 62/30; 62/40

[58] Field of Search ..... 62/8, 9, 13, 24, 40, 62/30

[56] References Cited

U.S. PATENT DOCUMENTS

| | | | |
|---|---|---|---|
| 4,211,544 | 7/1980 | Springmann | 62/40 X |
| 4,437,312 | 3/1984 | Newton et al. | 62/50.2 X |
| 4,582,519 | 4/1986 | Someya et al. | 62/9 X |
| 4,638,639 | 1/1987 | Marshall et al. | 62/9 |
| 4,894,076 | 1/1990 | Dobracki et al. | 62/9 |

*Primary Examiner*—Henry A. Bennet
*Assistant Examiner*—Christopher B. Kilner
*Attorney, Agent, or Firm*—Willard Jones, II; William F. Marsh; James C. Simmons

[57] ABSTRACT

The present invention relates to a process for the liquefaction of a nitrogen stream produced by separating air components using the combination of cryogenic distillation with improved refrigeration. Very cold liquid natural gas (LNG) is employed as refrigerant, with the LNG concurrently being revaporized for transportation. The requisite circulating liquid is produced by compressing the nitrogen feed streams in a multi-stage compressor, wherein the interstage cooling is provided by heat exchange against the part of the recirculating nitrogen stream yielding a high pressure nitrogen stream. The resulting nitrogen, having a pressure greater than that of the LNG refrigerant, is then used as the circulating fluid to transfer refrigeration from the LNG to other low pressure nitrogen feed streams prior to their cold compression. Also, high pressure nitrogen is used as circulating fluid to transfer refrigeration to precool feed air to cryogenic temperatures prior to its compression in an air separation unit. A portion of the high pressure nitrogen is condensed against vaporizing LNG, followed by reducing the pressure of the condensed, high pressure nitrogen stream, producing a two phase nitrogen stream, which is phase separated into a liquid nitrogen product.

8 Claims, 4 Drawing Sheets

LIQUEFIED NATURAL GAS REFRIGERATION TRANSFER TO A CRYOGENICS AIR SEPARATION UNIT USING HIGH PRESURE NITROGEN STREAM

TECHNICAL FIELD OF THE INVENTION

The present invention relates to a process for liquefaction of nitrogen produced by separating air by cryogenic distillation using an improved refrigeration source, particularly, vaporizing LNG, to yield the liquefied nitrogen.

BACKGROUND OF THE INVENTION

The separation of air to produce oxygen, nitrogen, argon, and other materials is done by distillation under low pressure to achieve power conservation. It is known that the refrigeration available from liquefied natural gas (LNG) can be utilized for cooling feed air and/or compressing component gases.

When pipelines are not feasible, natural gas is typically liquefied and shipped as a bulk liquid. At the receiving port, this liquefied natural gas (LNG) must be vaporized and heated to ambient temperatures. An efficient use of this refrigeration at the time of vaporization is highly desirable. It is becoming more common to build air separation plants with liquefiers which utilize the refrigeration available from the vaporizing LNG. An efficient scheme, which more effectively utilizes the refrigeration available from LNG to produce liquid products from air, can lead to substantial savings in energy and capital investment.

Several publications disclose the production of liquid nitrogen by indirect heat exchange against vaporizing LNG. Since the coldest temperature of LNG is typically above −260° F., the nitrogen must be at a pressure greater than ambient pressure in order to be condensed because the normal boiling point of nitrogen is −320° F. Typically, to condense at temperatures of about −260° F., the nitrogen must be compressed to above 225 psia. Compression of the nitrogen prior to its condensation by heat exchange with LNG is one of the major sources of energy consumption in producing a liquid nitrogen product.

U.S. Pat. No. 3,886,758 discloses a method wherein a nitrogen stream is compressed to a pressure of about 15 atm (221 psia) and then condensed by heat exchange against vaporizing LNG. Since all the gaseous nitrogen is not precooled against the warming natural gas prior to compression, the amount of energy required for the nitrogen compressor is quite high.

U.K. patent application no. 1,520,581 discloses a process of using the excess refrigeration capacity associated with a natural gas liquefaction plant to produce additional LNG, specifically for the purpose of providing refrigeration for the liquefaction of nitrogen. In the process, the nitrogen gas from the air separation plant to be liquefied is compressed without any precooling with LNG.

Yamanouchi and Nagasawa (*Chemical Eng. Progress*, pp 78, July 1979) describe another method of using LNG refrigeration for air separation. Once again, nitrogen at about 5.2 atm is compressed to about 31 atm without any precooling. Moreover, in this paper, LNG is vaporized in the LNG heat exchanger at close to ambient pressure (15 psia).

U.K. Pat. No. 1,376,678 teaches that evaporation of LNG at close to atmospheric pressure is inefficient because the vaporized natural gas must be admitted into a distribution pipeline at a pressure at which it can reach its destination, i.e., a transport pressure. This transport pressure is much higher than atmospheric pressure usually not exceeding 70 atm (1029 psi). Therefore, if LNG is vaporized at atmospheric pressure, then a considerable amount of energy is required to recompress the vaporized gas to its transport pressure. As a result, in U.K. Pat. No. 1,376,678, the LNG is first pumped to the desired pressure and then vaporized. Unfortunately, the process of refrigeration energy recovery taught in this patent is inefficient because not all of the refrigeration available from the LNG is recovered and the vaporized natural gas leaving the LNG heat exchanger is still quite cold (−165° F.). This incomplete recovery of refrigeration implies that, for this process, large quantities of LNG will be required to produce the desired quantity of liquid nitrogen. Japanese patent publication no. 52-37596 (1977) teaches vaporizing low pressure LNG against an elevated pressure nitrogen stream, which is obtained directly from a distillation column which operates at an elevated pressure. In the process, only part of the LNG is vaporized against the condensing nitrogen and the remainder of the LNG is vaporized in the other heat exchangers; this is an inefficient use of the refrigeration energy of LNG. The vaporized natural gas is then compressed.

U.S. Pat. No. 3,857,251 discloses a process for producing liquid nitrogen by extraction of nitrogen from the vapors resulting from the evaporation of LNG in storage tanks. The gaseous nitrogen is compressed in a multistage compressor with interstage cooling provided by water, air, propane, ammonia, or fluorocarbons.

Japanese patent publication no. 46-20123 (1971) teaches cold compression of a nitrogen stream which has been cooled by vaporizing LNG. Only a single stage of nitrogen compression is used. As a result, an effective use of LNG cold energy, which vaporizes over a wide range of temperature, is not obtained.

Japanese patent publication no. 53-15993 (1978) teaches the use of LNG refrigeration for the high pressure nitrogen drawn off the high pressure column of a double column air distillation system. The nitrogen is cold compressed in a multistage compressor, but without any interstage cooling with LNG.

German Pat. No. 2,307,004 describes a method for recovering LNG refrigeration to produce liquid nitrogen. Nitrogen gas from the warm end of a cryogenic air separation plant is close to ambient pressure and ambient temperature. This feed nitrogen is compressed, without any LNG cooling, in a multistage compressor. A portion of this compressed gas is partially cooled against LNG and expanded in an expander to create low level refrigeration. The other portion of compressed nitrogen is cold compressed and condensed by heat exchange against the expanded nitrogen stream. The expanded gas is warmed and recompressed to an intermediate pressure and then fed to the nitrogen feed compressor operating with an inlet temperature close to ambient. It is clear that most of the nitrogen compression duty is provided in compressors with inlet temperature close to ambient temperature and that no interstage cooling with LNG is provided in these compressors.

U.S. Pat. Nos. 4,054,433 and 4,192,662 teach methods whereby a closed loop, recirculating fluid is used to transfer refrigeration from the vaporizing LNG to a condensing nitrogen stream. In U.S. Pat. No. 4,054,433, a mixture of methane, nitrogen, ethane or ethylene and $C_3+$ is used to balance the cooling curves in the heat exchangers. The gaseous nitrogen from the high pressure column (pressure TM 6.2 atm) is liquefied without any further compression. However, a large fraction of nitrogen is produced at close to ambient pressure from a conventional double column air distillation apparatus. Its efficient liquefaction would require a method to practically compress this nitrogen stream, which is not suggested in this U.S. patent.

In U.S. Pat. No. 4,192,662, fluorocarbons are used as recirculating fluid wherein it is cooled against a portion of the vaporizing LNG and then used to cool low to medium pressure nitrogen streams. This scheme presents some problems and/or inefficiencies. Energy losses due to fluorocarbon recirculation are large; requiring additional heat exchangers and a pump. Furthermore, the use of fluorocarbons has negative environmental implications and use of alternate fluids are expensive.

Japanese patent publication no. 58-150786 (1983) and European patent application no. 0304355-A1, (1989) teach the use of an inert gas recycle such as nitrogen or argon to transfer refrigeration from the LNG to an air separation unit. In this scheme, the high pressure inert stream is liquefied with natural gas, and then revaporized in a recycle heat exchanger to cool a lower pressure inert recycle stream from the air separation unit. This cooled lower temperature inert recycle stream is cold compressed and a portion of it is mixed with the warm vaporized high pressure nitrogen stream. The mixed stream is liquefied against LNG and fed to the air separation unit to provide the needed refrigeration and then returned from air separation unit as warm lower pressure recycle stream. Another portion of the cold compressed stream is liquefied with heat exchange against LNG and forms the stream to be vaporized in the recycle heat exchanger. These schemes are inefficient. For example, all of the recirculating fluids are cold compressed in a compressor with no interstage cooling with LNG.

Cold compression of air is described in Japanese patent application nos. 53/124188-A and 51/140881. In both disclosures, feed air is cooled by direct heat exchange, i.e., air and LNG are fed through the same heat exchanger. This seems to reduce power consumption for the main air compressor. However, their flow passages appear adjacent to one another. If the pressure of the LNG were higher than that of the ambient air, then any leakage of hydrocarbons to the air stream would present an explosion hazard in the downstream air separation unit cold box. In fact, the feed air pressure to the air separation unit is usually less than 100 psia, while vaporized LNG is greater than 500 psia.

BRIEF SUMMARY OF THE INVENTION

The present invention relates to a cryogenic air separation process for the production of liquid nitrogen. In the process, means are taught to more effectively utilize the refrigeration available from vaporizing LNG to produce liquid component products from air, preferably nitrogen, with substantial savings in energy and capital investment.

A key feature of the disclosed process is that a high pressure nitrogen stream, usually taken from an air separation unit and liquefied, but having a pressure greater than that of the vaporizing LNG stream, is used as the circulating fluid in lieu of fluorocarbon type heat pump fluids. This nitrogen circulating fluid serves to transfer refrigeration from LNG to other lower pressure nitrogen streams for their multi-stage cold compression using interstage stream feed precooling.

The high pressure, gaseous nitrogen stream, being employed at a pressure greater than that of the vaporizing LNG stream, is also used as a recirculating fluid to precool the lower pressure nitrogen streams prior to their compression, which are to be liquefied.

In another embodiment, the high pressure circulating nitrogen stream is further used to transfer some of the LNG refrigeration to precool the air feed to cryogenic temperature levels, prior to its compression in an air separation unit in at least one stage of the main compressor.

According to the invention, a process is provided for the liquefaction of a nitrogen stream produced by a cryogenic air separating unit, having at least one distillation column, comprising: (a) cooling recirculating nitrogen in heat exchange against vaporizing liquefied natural gas, wherein the recirculating nitrogen has a pressure greater than the pressure of the vaporizing liquefied natural gas; (b) compressing the nitrogen stream to a pressure of at least 300 psi in a multi-stage compressor, wherein interstage cooling is provided by heat exchange against the recirculating nitrogen stream, thereby producing a high pressure nitrogen stream; (c) condensing at least a portion of the high pressure nitrogen stream by heat exchange against vaporizing liquefied natural gas; (d) reducing the pressure of the condensed, high pressure nitrogen stream portion, thereby producing a two phase, nitrogen stream; (e) phase separating the two phase, nitrogen stream into a liquid nitrogen stream and a nitrogen vapor stream; and (f) warming the nitrogen vapor stream to recover refrigeration.

A variation of the above described process comprises subcooling the condensed, high pressure nitrogen stream from step (c) prior to reducing the nitrogen stream pressure in step (d), by heat exchange against the warming nitrogen vapor stream from step (f). This variation can further comprise recycling the warmed nitrogen vapor stream from step (f) to one of the intermediate stages of the multi-stage compressor of step (a).

In another embodiment of the described process, the reduction in nitrogen stream (d) is accomplished by work expanding the condensed, high pressure nitrogen stream in a dense fluid expander.

In another major process embodiment, a portion of the high pressure nitrogen stream of step (b) forms the recirculating nitrogen stream of step (a), which further comprises recirculating the recirculating nitrogen a plurality of times between at least two heat exchangers, thereby transferring refrigeration from the vaporizing liquefied natural gas to same for the interstage cooling of step (b) and for precooling the nitrogen stream of step (a) prior to compression in step (b).

In a variation of the just described major embodiment, at least one portion of the recirculating nitrogen stream is removed while transferring refrigeration.

A third major process embodiment further comprises combining the high pressure nitrogen product stream of step (b) with the recirculating nitrogen stream of step (a); further cooling this combined stream by heat exchange against vaporizing liquefied natural gas; and then condensing at least a portion of the combined streams in heat exchange against vaporizing LNG as in step (c) of the first embodiment.

A fourth major process embodiment further comprises use of the recirculating nitrogen to transfer refrigeration from the LNG to at least one intermediate stage of the feed air compressor supplying feed air to the air separation unit.

DETAILED DESCRIPTION OF THE INVENTION

The present invention relates to an improved process for converting low and high pressure gaseous air components, like nitrogen, flowing from an air separation unit, by using a high pressure nitrogen stream as the recirculating fluid, to transfer refrigeration from the vaporizing LNG to warm, low pressure air component streams in a more efficient manner.

Figure 1:
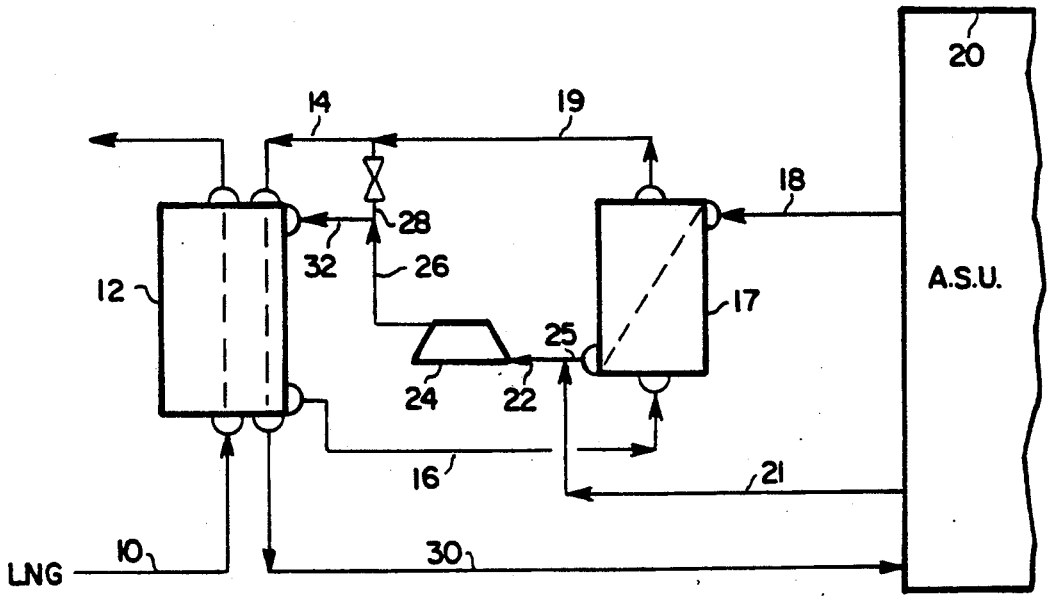
FIG. 1 PRIOR ART
FIG. 1 is a flow diagram of a state-of-the-art nitrogen liquefaction process, in which an inert gas like nitrogen serves as the recirculation fluid to transfer refrigeration from the LNG to an air separation cold box and to produce a liquid nitrogen product.

Referring now to the drawing and to FIG. 1, in particular, a state-of-the-art cryogenic process using nitrogen to transfer the cold energy of the LNG to the process feed streams is shown. Refrigerant LNG stream 10 is passed through a heat exchanger 12 against high pressure, inert gas stream 14, which is to be liquefied, and pressurized nitrogen recycle stream 32. Cooled pressurized nitrogen recycle stream 16 is sent to recycle heat exchanger 17, where it is revaporized in heat exchange against lower pressure, recycle inert gas stream 18 flowing directly from air separation unit 20, and emerges as stream 19. Cold inert gas is withdrawn from air separation unit 20 as stream 21 and combined with cooled inert gas stream 25, with both passing to compressor 24. Emerging cooled inert gas stream 22 is cold compressed in compressor 24, and resulting compressed stream 26 is split, with a first portion passing as stream 28 to be combined with vaporized high pressure nitrogen stream 19. This combined stream 14 is liquefied in heat exchanger 12 against LNG, and is then fed, as stream 30, directly back to the air separation unit 20.

The balance (second portion) of compressed stream 26 from compressor 24, stream 32, is liquefied against the LNG in exchanger 12, wherein it forms liquid stream 16 to be vaporized in recycle exchanger 17 and emerging as warm vaporized nitrogen stream 19.

Figure 5:
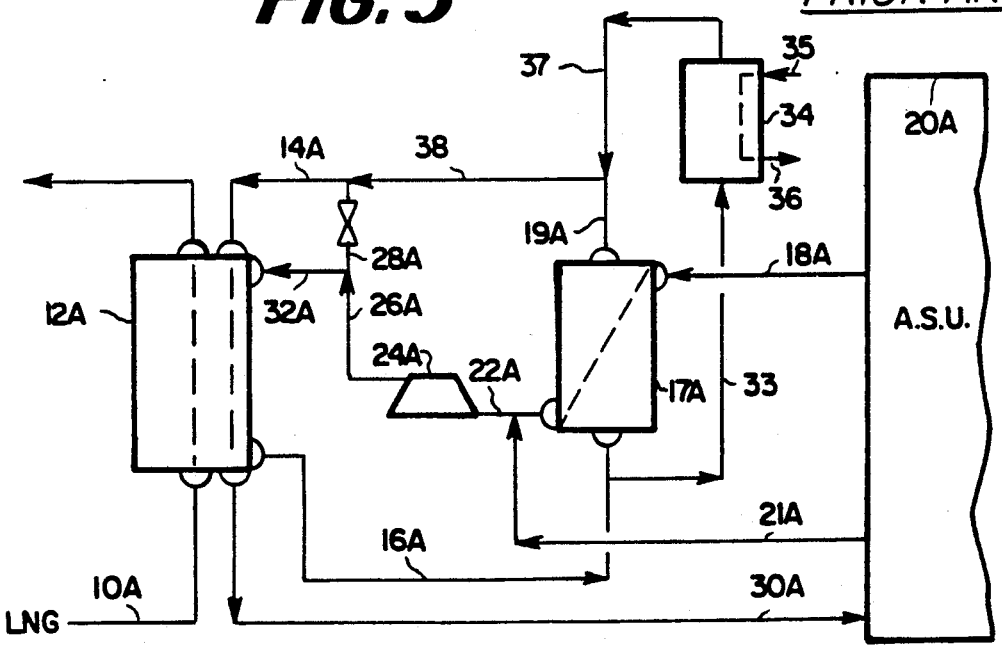
FIG. 5 PRIOR ART
FIG. 5 is a flow diagram of an alternate embodiment of the state-of-the-art nitrogen liquefaction process of FIG. 1, in which another heat exchanger has been interposed in a bypass stream of the bottom feed stream to the recycle exchanger and also connects with the overhead product stream of that exchanger.

In an alternate prior art embodiment, shown in FIG. 5, liquefied inert gas 16A is split into two portions. A first portion is fed, via line 33, to heat exchanger 34, wherein it is vaporized against cooling feed air stream 35. This cooled feed air stream is fed to a desired destination (not shown) via conduit 36. The vaporized first portion is withdrawn as cold inert gas stream 37, and is rejoined with main cold inert gas stream 19A from recycling heat exchanger 17A to form stream 38, which flows back to exchanger 12A.

In the above described processes, the flow rates of the inlet nitrogen streams being cooled in exchangers remain unaltered between the warm end and the cold ends of the exchanger. Due to variations in the heat capacity of LNG (over the liquid temperature range of this application) and the high pressure nitrogen streams which are heat exchanged against the LNG, unbalanced cooling curves will result. Moreover, the fact that the cold compression is done in a single compressor, with no interstage cooling by LNG, will contribute to the thermodynamic inefficiency of these earlier approaches.

The process of the present invention will now be described with respect to a preferred embodiment for the liquefaction of nitrogen obtained from a cryogenic air separation unit. The air separation unit usable for this purpose is any conventional, double-column air distillation process. The details of such an air separation process can be found in a paper by R. E. Latimer, "Distillation of Air", *Chemical Engineering Progress*, pp 35–39, February, 1967. Moreover, the present invention is applicable to almost any distillation column configuration.

Figure 2:
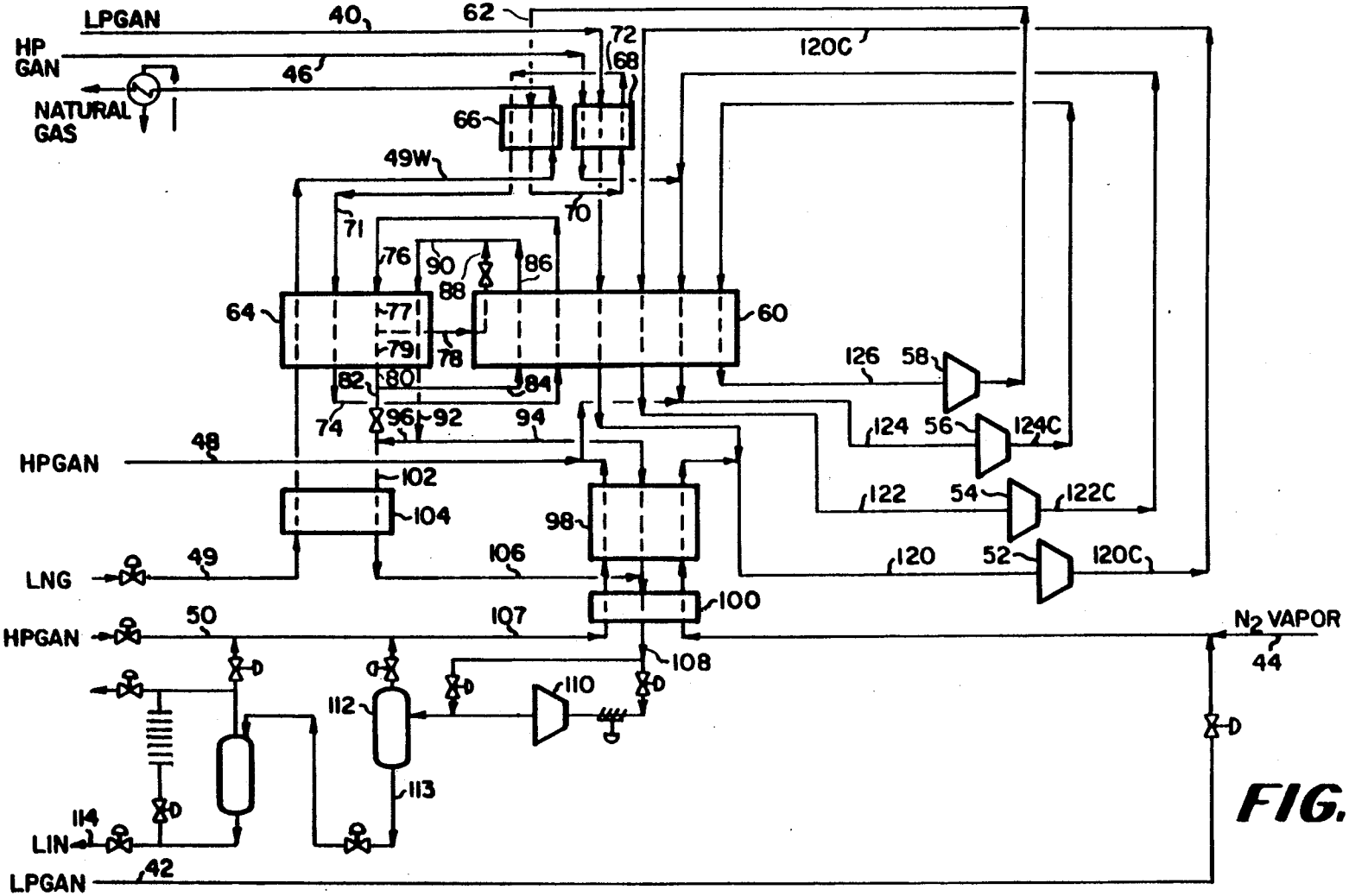
FIG. 2 is a flow diagram of a specific embodiment of the process of the present invention, involving a highest pressure nitrogen stream serving as the circulating fluid in the multi-stage compression of the air component feed streams to be liquefied, and involving interstage cooling of the pressure-boosted process streams.

FIG. 2 depicts a schematic of the process of the present invention for the liquefaction of nitrogen. In the process, nitrogen, which is to be liquefied, is supplied from the air separation unit (not shown) as plurality of high pressure and low pressure streams. The high pressure nitrogen stream comes from the high pressure column (not shown), operating at pressures greater than 75 psia; and the low pressure nitrogen is obtained from the lower pressure column (not shown), operating at pressures greater than, or close to, ambient pressure. These streams are supplied as warm (close to ambient temperature) and as comparatively cold streams. This supply of cold and warm streams is done to balance the cooling curves for the heat exchangers used to cool the feed air to the air separation unit.

Low pressure nitrogen streams 40, 42 and 44 and high pressure nitrogen streams 46, 48 and 50 from the air separation unit are cold compressed in multistages by compressors 52, 54, 56 and 58. Precooling prior to each compression is primarily conducted in warm end heat exchanger 60. LNG is not fed directly to warm end heat exchanger 60, instead, highest pressure nitrogen stream 62 is circulated between heat exchangers 60 and 64 to cool some of the other inlet nitrogen streams.

In this embodiment, highest pressure nitrogen stream 62 is first partially cooled in heat exchanger 66 and is then warmed in heat exchanger 68 as stream 70, while cooling low pressure inlet nitrogen stream 40 and high pressure nitrogen stream 46. Warmed stream 72 is again cooled with LNG in heat exchangers 66 and 64 to provide cold stream 74. Cold stream 74 is then used to provide the cooling duty in heat exchanger 60, and the warmed stream 76 is again partially cooled in the heat exchanger 64. Partially cooled stream 77 is split into two streams. One stream 78 is returned to heat exchanger 60 to provide partial cooling duty, while second stream 79 is further cooled in heat exchanger 64 to obtain cold stream 80. Cold stream 80 is split into streams 82 and 84. Some of the cooling duty in heat exchanger 60 is provided by stream 84. Warmed streams 86 and 88 are combined into stream 90 and combined stream 90 is again cooled in heat exchanger 64 with LNG.

Cooled stream 92 is split into streams 94 and 96. Stream 94 is sent through heat exchangers 98 and 100, to be condensed and subcooled against the returning low pressure cold nitrogen streams. Stream 96 is combined with stream 82 into stream 102 and combined stream 102 is condensed and cooled in heat exchanger 104 with LNG. Highest pressure liquid nitrogen stream 106 is sent to heat exchanger 100 for further cooling against the returning lower pressure nitrogen streams, e.g., 107. Finally, coldest nitrogen stream 108 is let down in pressure in expander 110, and liquid nitrogen stream 113 is ultimately sent to the air separation unit for further treatment.

Due to LNG cooling, the temperature of cold nitrogen streams 70 and 71 exiting from heat exchanger 66, is in the range of −50° F. to −120° F. Similarly, the temperature of cooled discharge nitrogen streams 74, 78, 80 and 92, exiting from heat exchanger 64, will typically be in the range of −50° F. to −260° F., and more likely from −90° F. to −220° F. The liquid nitrogen product from the liquefier is sent to the air separation unit (not shown) for further processing and the production of liquid products. From the air separation unit, other liquid products, such as liquid oxygen and liquid argon can be easily produced by using the refrigeration from the liquid nitrogen supplied from the liquefier.

In FIG. 2, highest pressure nitrogen stream 62 from the final stage of compressor 58 is used as a circulating fluid to transfer refrigeration from LNG to the lower pressure nitrogen streams which are then stage-wise, cold compressed (stages 52, 54, 56).

In another important variation to the process, this circulating nitrogen can also be used to transfer refrigeration to the feed air stream, prior to its compression, in at least one stage of the main air compressor. This embodiment requires that air compression used to supply compressed air to the air separation unit be done in two stages. In the first stage, air is compressed to an intermediate pressure in the main air compressor, and passed through a molecular sieve bed for water and carbon dioxide removal. It is then possible to cool air, which is free of water and carbon dioxide, to cryogenic temperatures in a heat exchanger utilizing cold high pressure nitrogen from either heat exchanger 66 or 64. The cooled air stream is then cold compressed to the pressure required by the air separation unit. The warmed nitrogen stream is returned to heat exchangers 66, 64 for recooling.

Figure 3:
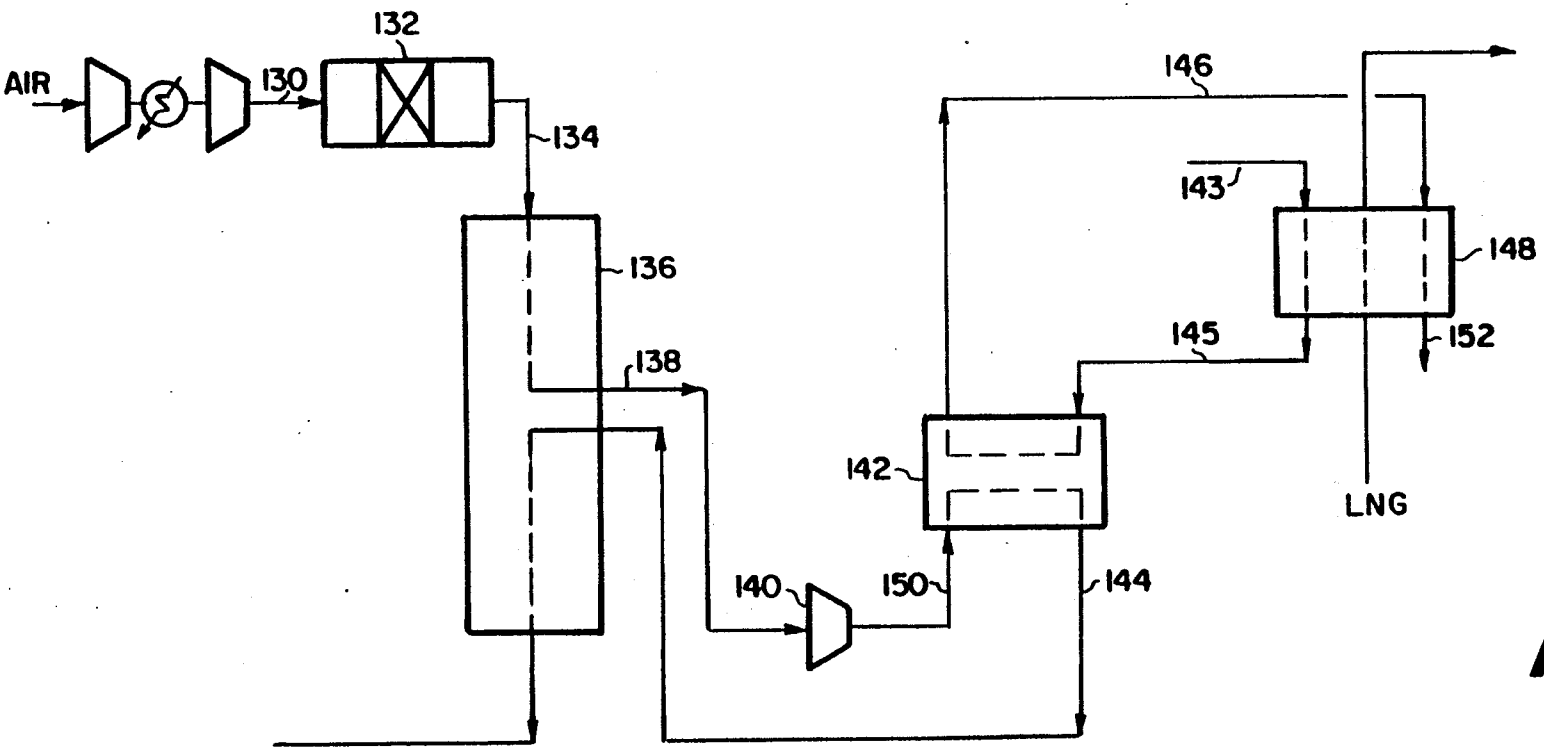
FIG. 3 is a flow diagram of another embodiment of the process of FIG. 2 concerning a means of pretreatment of the air feed to the air separation unit which provides the process stream feeds to the liquefaction process.

An alternative embodiment to precool air before multi-stage compression in an air separation unit is shown in FIG. 3. In this schematic, medium pressure air stream 130 is sent through molecular sieve bed 132. Emerging water and carbon dioxide-free air stream 134 from molecular sieve bed 132 is partially cooled in main heat exchanger 136 of the air separation unit. Partially cooled air stream 138 is compressed in compressor 140, then cooled in heat exchanger 142, and returned to the main heat exchanger 136 as stream 144 for further processing.

Highest pressure nitrogen stream 143 (derived from highest pressure nitrogen stream 62 of FIG. 2) is cooled with LNG in heat exchanger 148 and then sent back via conduit 145 to heat exchanger 142 to cool compressed air stream 150. Warmed nitrogen stream 146 is then recycled to heat exchanger 148 for recooling. Cooled stream 152 is processed in a manner analogous to cooled highest pressure, nitrogen stream 62 in FIG. 2.

This embodiment can be successfully used when the refrigeration available from LNG is in excess of that needed for cold compression of gaseous nitrogen feed to produce liquid nitrogen. The result is a substantial reduction in the total air compression power. Some calculations were done for a model where air was cooled prior to compression in the fourth stage of the main air compressor (not shown). Main air compressor power was reduced by about 9%. If refrigeration were to be used to cool air, prior to the earlier stages of compression (e.g., prior to third stage of compression), then even greater energy savings would be realized.

Several other variations of the process shown in FIG. 2 are available. A better match between the cooling curves in the heat exchangers may be obtained by removing the restriction that streams 74, 80 and 92 be at the same temperature. These stream temperatures coming out of the heat exchanger 64 can be individually adjusted to give the minimum power use for liquid nitrogen production. Also, there can be more than one warmer (relatively) stream similar to side stream 78, withdrawn from warm heat exchanger 64. These such degrees of freedom, with circulating nitrogen stream in FIG. 2, serve to make the cooling curves more efficient and thus result in lower power consumption.

Furthermore, feed streams to cold compressors 52 to 58 need not be at the same temperature. They can be chosen to minimize the losses associated with the cooling curves in the heat exchangers 66, 64, 68 and 60.

Figure 4:
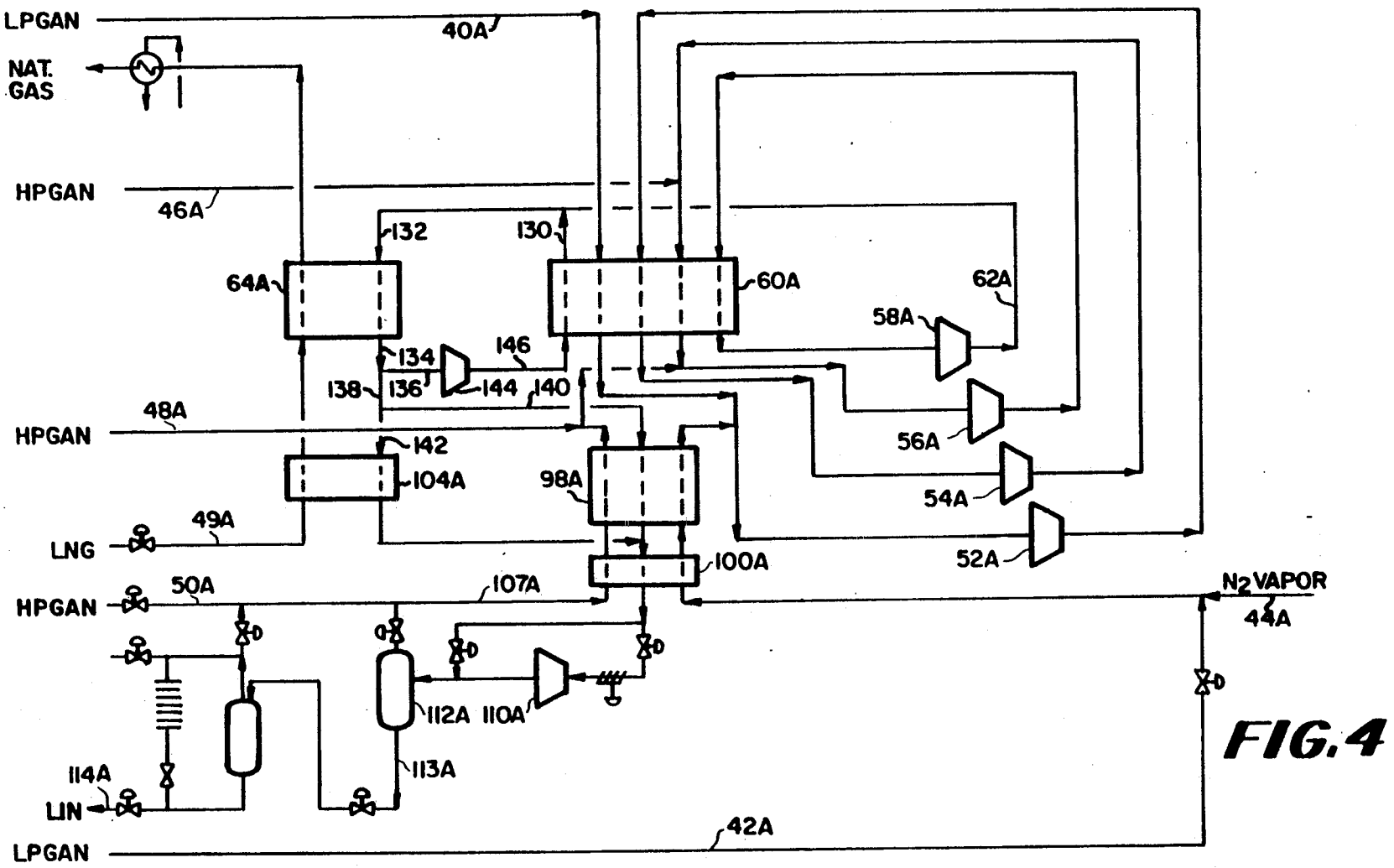
FIG. 4 is a flow diagram of yet another embodiment of the process of FIG. 2, involving a differing configuration and number for the upstream heat exchangers, which precool and recool the inlet feed streams, as well as their intermediate compression stage products.

It is also possible to simplify the process of FIG. 2. Rather than circulating multiple streams between heat exchangers 64 and 60, a single circulating nitrogen stream could be used. A simplified arrangement is shown in FIG. 4. In this embodiment, highest pressure nitrogen stream 62A from compressor 58A is mixed with recirculating nitrogen stream 130, forming combined stream 132. Combined stream 132 is then cooled with LNG in heat exchanger 64A to provide cold stream 134, which is then split into streams 136 and 138. Stream 138 is then further split into streams 140 and 142 and fed to heat exchangers 98A, 104A, respectively, for added refrigeration.

Stream 136 is boosted in pressure to compensate for pressure drop in heat exchangers 60A and 64A by booster compressor 144. Boosted pressure stream 146 is then fed to heat exchanger 60A to cool lower pressure feed nitrogen stream 40A, and the other cooling nitrogen streams from the cold compression stages.

The pressure of warmed nitrogen stream 130 is the same as highest pressure nitrogen stream 62A from the final stage of compressor 58A; so the two streams are mixed together, as noted earlier. This combination is inherently safe, since the pressure of combined stream 132 is greater than the LNG pressure and, therefore, leakage of LNG stream 49A into nitrogen stream 132 is not possible.

In the embodiment shown in FIG. 4, it is also possible to boost the pressure of stream 130, instead of stream 136.

The embodiment of FIG. 4 is simpler, since there is a lower number of flow passages in heat exchangers 64A and 60A, however, it will be less efficient than the process of FIG. 2. To increase the efficiency of the embodiment of FIG. 4, a split stream could be split from stream 132 in the middle of heat exchanger 64A, and the split stream could be sent to an intermediate point of 60A, where it is treated in a manner analogous to stream 78 in FIG. 2, flowing between exchangers 64 and 60.

The advantage of the process of FIG. 4 is that it is simple, and yet does not require storage for another circulating fluid, such as fluorocarbon, etc. The circulating, high pressure nitrogen stream in line 146 can be established at the start up of the plant, by the nitrogen supply from the air separation unit. Alternatively, it could also be obtained by vaporization of liquid nitrogen from the storage tanks (not shown).

The current invention provides an efficient process to recover refrigeration from LNG which is to be vaporized. By using this refrigeration, liquid nitrogen is produced, and also the power consumption of the main air compressor supplying feed air to the air separation unit is decreased. (It does not use any recirculating fluorocarbon liquid). The interstage cooling of the nitrogen compressors is provided by recirculating a nitrogen stream with pressure higher than the vaporizing LNG. In the preferred mode, this recirculating nitrogen is the same stream which is subsequently condensed to provide liquid nitrogen product. In this preferred mode, no recirculation pump is required.

LNG is typically composed of more than one component and they each vaporize at different temperatures. This leads to fairly high heat capacities of the vaporizing natural gas over a wide range of temperatures. On the other hand, the heat capacity of the cooling nitrogen streams is a strong function of temperature and pressure. For temperatures in the range of ambient down to −200° F., heat capacity of a nitrogen stream at pressures below 100 psia is about 7 BTU/lb mole °F. Whereas, a nitrogen stream at 800 psia has a heat capacity of about 7.6 BTU/lb mole °F. at 75° F., 9.0 BTU/lb mole °F. at −100° F., 11 BUT/lb mole °F. at −150° F., and about 24.0 BTU/lb mole °F at −200° F.

The LNG stream (91.4% $CH_4$, 5.2% $C_2H_6$ and 3.4% $C_2$+) at 725 psia has approximate heat capacities of 14 BTU/lb mole °F., in the temperature range of −160° F. to −240° F.; 19.6 BTU/lb mole °F. at −120° F., 25.6 BTU/lb mole °F. at −100° F., 21.5 BTU/lb mole °F. at −50° F., and 11.5 BTU/lb mole above 0° F. Thus, in FIG. 2, the amount of LNG used to cool highest pressure (750 psia), nitrogen stream 62 in cold heat exchanger 104 (−180° F. to −250° F. temperature range), will have more refrigeration to cool streams other than highest pressure nitrogen stream 102 at warmer temperatures in heat exchanger 64 and 66. As a result, highest pressure nitrogen stream 62 is recirculated several times through heat exchangers 64 and 66 to adequately transfer refrigeration from LNG to other low to medium pressure nitrogen streams which have been cold compressed in the various stages. To allow a better match of cooling curves in the heat exchangers and maximize the transfer of refrigeration from the LNG to the cool streams of nitrogen being compressed in compressors 52, 54, 56 and 58, a relatively warmer stream 78 from heat exchanger 64 is withdrawn and circulated through heat exchanger 60 to take advantage of the situation that vaporizing natural gas still has fairly high heat capacities, while the circulating nitrogen gas has much lower heat capacities (in the temperature range above −100° F.).

In FIG. 2, the employment of a dense fluid expander 110 and heat exchanger 98, to create a portion of the condensing nitrogen stream against the low temperature nitrogen stream, leads to increased efficiency compared to known process. The apparent closest prior art to the proposed process is taught in European patent application no. 0304355-A (FIGS. 1 and 5), which is summarized earlier in the Background section of this specification.

The proposed process is manifestly more efficient than this European publication because:

(a) In the process of the subject European patent application, the flow rates of the nitrogen streams being cooled remain unchanged between the warm and the cold end of the heat exchanger. As discussed earlier, due to differences between heat capacities of LNG and high pressure nitrogen streams, this will lead to fairly unbalanced cooling curves.

(b) In the process of the subject European patent application, the high pressure recycle stream is liquefied (i.e., cooled to within a few degrees of LNG), and then revaporized to cool the lower pressure warmer nitrogen stream. On the other hand, the process of the present invention as depicted in FIG. 2 utilizes all the lower temperature refrigeration to make the final liquid nitrogen product and cools the nitrogen streams for cold compression to no more than about −200° F. This combination of steps allows the production of larger quantities of liquid nitrogen with lower power consumption.

In the embodiment shown in FIG. 2, once the highest pressure nitrogen stream starts circulating between heat exchangers to cool the low pressure nitrogen streams, no other stream from the cold compressors mixes with this highest pressure nitrogen stream.

This is unlike the European patent application where such a mixing is done in an attempt to reduce the flow of cold high pressure nitrogen stream through the recycle heat exchanger. On the other hand, the embodiment shown in FIG. 2 circulates all the high pressure nitrogen stream to be condensed more than once, prior to condensation, and this leads to optimum cooling curves in the heat exchangers.

The present invention has been described with reference to some specific embodiments thereof. These embodiments should not be considered a limitation of the scope of the present invention. The scope of the present invention is ascertained by the following claims.

I claim:

1. A process for the liquefaction of a nitrogen stream produced by a cryogenic air separation unit having at least one distillation column comprising:

(a) cooling recirculating nitrogen in heat exchange against vaporizing liquefied natural gas, wherein the recirculating nitrogen has a pressure greater than the pressure of the vaporizing liquefied natural gas;

(b) compressing the nitrogen stream to a pressure of at least 300 psi in a multi-stage compressor wherein interstage cooling is provided by heat exchange against the recirculating nitrogen stream thereby producing a high pressure nitrogen stream;

(c) condensing at least a portion of the high pressure nitrogen stream by heat exchange against vaporizing liquefied natural gas;

(d) reducing the pressure of the condensed, high pressure nitrogen stream portion thereby producing a two phase nitrogen stream;

(e) phase separating the two phase nitrogen stream into a liquid nitrogen stream and a nitrogen vapor stream; and (f) warming the nitrogen vapor stream to recover refrigeration.

2. The process of claim 1 which further comprises subcooling the condensed, high pressure nitrogen stream of step (c) prior to reducing the pressure in step (d) by heat exchange against the warming nitrogen vapor stream of step (f).

3. The process of claim 1 which further comprises recycling the warmed nitrogen vapor stream of step (f) to an intermediate stage of the multi-stage compressor of step (b).

4. The process of claim 1 wherein the reduction in pressure of step (d) is accomplished by work expanding the condensed, high pressure nitrogen stream in a dense fluid expander.

5. The process of claim 1 wherein a portion of the high pressure nitrogen stream of step (b) forms the recirculating nitrogen of step (a) and which further comprises recirculating the recirculating nitrogen a plurality of times between at least two heat exchangers thereby transferring refrigeration from the vaporizing liquefied natural gas for the interstage cooling of step (b) and for precooling the nitrogen stream of step (b) prior to compression in Step (b).

6. The process of claim 5 wherein at least one portion of the recirculating nitrogen stream is removed while transferring refrigeration.

7. The process of claim 1 which further comprises combining the high pressure stream of step (b) with the recirculating nitrogen stream of step (a); further cooling this combined stream by heat exchange against vaporizing liquefied natural gas; and then condensing at least a portion of the combined stream according to step (c).

8. The process of claim 1 which further comprises using at least a portion of the recirculating nitrogen of step (a) to transfer refrigeration from vaporizing liquefied natural gas to provide intercooling for at least one stage of a multi-stage feed air compressor used to compress feed air to the cryogenic air separation unit.

* * * * *